US007556546B2

(12) United States Patent
Okuyama et al.

(10) Patent No.: US 7,556,546 B2
(45) Date of Patent: Jul. 7, 2009

(54) REMOTE CONTROL SYSTEM FOR BOAT

(75) Inventors: Takashi Okuyama, Shizuoka-ken (JP); Takahiro Oguma, Shizuoka-ken (JP); Makoto Ito, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 354 days.

(21) Appl. No.: 11/644,675

(22) Filed: Dec. 22, 2006

(65) Prior Publication Data

US 2007/0149070 A1 Jun. 28, 2007

(30) Foreign Application Priority Data

Dec. 28, 2005 (JP) ..... 2005-377899

(51) Int. Cl.
*B60W 10/04* (2006.01)

(52) U.S. Cl. ..... 440/84

(58) Field of Classification Search ..... 192/51, 192/54.1; 440/75, 84, 86; 74/480 B
See application file for complete search history.

(56) References Cited

U.S. PATENT DOCUMENTS 6,957,989 B2 * 10/2005 Itoi ..... 440/1

FOREIGN PATENT DOCUMENTS

JP 2005-297785 10/2005

* cited by examiner

*Primary Examiner*—Ed Swinehart
(74) *Attorney, Agent, or Firm*—Keating & Bennett, LLP

(57) ABSTRACT

A remote control operation unit can have a remote control shift lever through which a boat operator can remotely select between forward, neutral, and reverse drive modes. A boat propulsion unit can have a shift switching device for shifting and a shift actuator for operating the shift switching device. A controller can be configured to control the operation of the shift actuator in response to the operation amount of the remote control shift lever. The controller can also be configured to control the shift actuator such that the shift actuator achieves a first target position that is a position beyond a reference position of the shift actuator where a dog clutch is in the middle of a neutral range, when the remote control shift lever has been shifted from either a forward position or a reverse position to a neutral position.

17 Claims, 10 Drawing Sheets

REMOTE CONTROL SYSTEM FOR BOAT

PRIORITY INFORMATION

This application is based on and claims priority to Japanese Patent Application No. 2005-377899, filed Dec. 28, 2006, the entire contents of which is hereby expressly incorporated by reference.

BACKGROUND OF THE INVENTIONS

1. Field of the Inventions

The present inventions relate to boats having a remote control units, and more particularly, remote control units with shift levers through which a boat operator can remotely control forward, neutral, and reverse drive modes.

2. Description of the Related Art

Japanese Patent Document JP-A-2005-2977851 discloses a shift system for a boat propulsion unit including a remote control operation unit having a remote control shift lever through which a boat operator can remotely shift the propulsion unit between forward, neutral, and reverse drive modes. The remote control operation unit also includes a boat propulsion unit having a shift switching device for selectively shifting between the forward, neutral, and the reverse drive modes and a shift actuator for operating the shift switching device. Control means are used for controlling the operation of the shift actuator in response to the operation amount of the remote control shift lever. The control means determines when the remote control shift lever has been operated within a certain range of a shift range from a neutral position, and then controls the operation amount of the actuator to the unit operation amount of the shift lever so as to vary with portions of the shift range.

Such conventional boats are configured such that the position of the remote control shift lever is first detected, then the shift actuator is controlled in response to the detected position of the remote control shift lever. For example, the shift switching device is operated by a driving force from the shift actuator. During operation, including when engine speed is relatively high, a dog clutch coupled to a propeller is in locking engagement with a forward or reverse gear.

SUMMARY OF THE INVENTIONS

An aspect of at least one of the embodiments disclosed herein includes the realization that to shift out of the forward position or the reverse position into a neutral position, a large force is needed to disengage the dog clutch from the forward or the reverse gear, thus requiring a large shift-out load from the shift actuator.

As a result, even when the shift actuator has been operated by a certain amount, the dog clutch might not move sufficiently to disengage due to a large reaction force from the engagement parts and for mechanical reasons such as a play of the shift switching device or a torsion on the input and output shafts. For electrically controlled shifting, a gain might become 0 even when the shift system is not in the neutral position, so that an actuator motor might stop, resulting in unsuccessful shift-out.

Thus in accordance with an embodiment, a boat can comprise a remote control operation unit having a remote control shift lever configured to allow a boat operator to remotely select a forward, neutral, and reverse drive mode. A boat propulsion unit can have a shift switching device configured to selectively shift between the forward, neutral, and reverse drive modes, and a shift actuator can be configured to operate the shift switching device. A control means can be provided for controlling the operation of the shift actuator in response to the operation amount of the remote control shift lever, when the remote control shift lever has been operated within a certain range of a shift range. Additionally, the control means can control the shift actuator such that the shift actuator achieves a first target position that is a position beyond a reference position of the shift actuator where a dog clutch is in the middle of a neutral range, when the remote control shift lever has been shifted from either a forward position or a reverse position to a neutral position.

In accordance with another embodiment, a boat can comprise a remote control operation unit having a remote control shift lever configured to allow a boat operator to remotely select a forward, neutral, and reverse drive mode. A boat propulsion unit can have a shift switching device configured to selectively shift between the forward, neutral, and reverse drive modes, and a shift actuator can be configured to operate the shift switching device. A controller can be configured to control the operation of the shift actuator in response to the operation amount of the remote control shift lever, when the remote control shift lever has been operated within a certain range of a shift range. The controller can also be configured to control the shift actuator such that the shift actuator achieves a first target position that is a position beyond a reference position of the shift actuator where a dog clutch is in the middle of a neutral range, when the remote control shift lever has been shifted from either a forward position or a reverse position to a neutral position.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENTS

Improved boats and remote control systems for boats are disclosed herein. Although the present boats and remote control systems are illustrated and described in the context of an outboard motor-powered boat, the present inventions can be used with other types of remote control systems and other types of vehicles.

Figure 1:
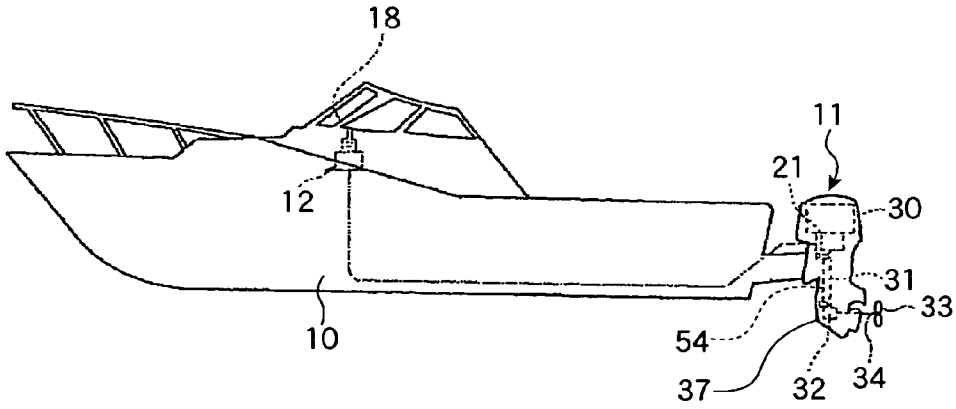
FIG. 1 is a schematic side elevational view of a boat in accordance with an embodiment.
Figure 2:
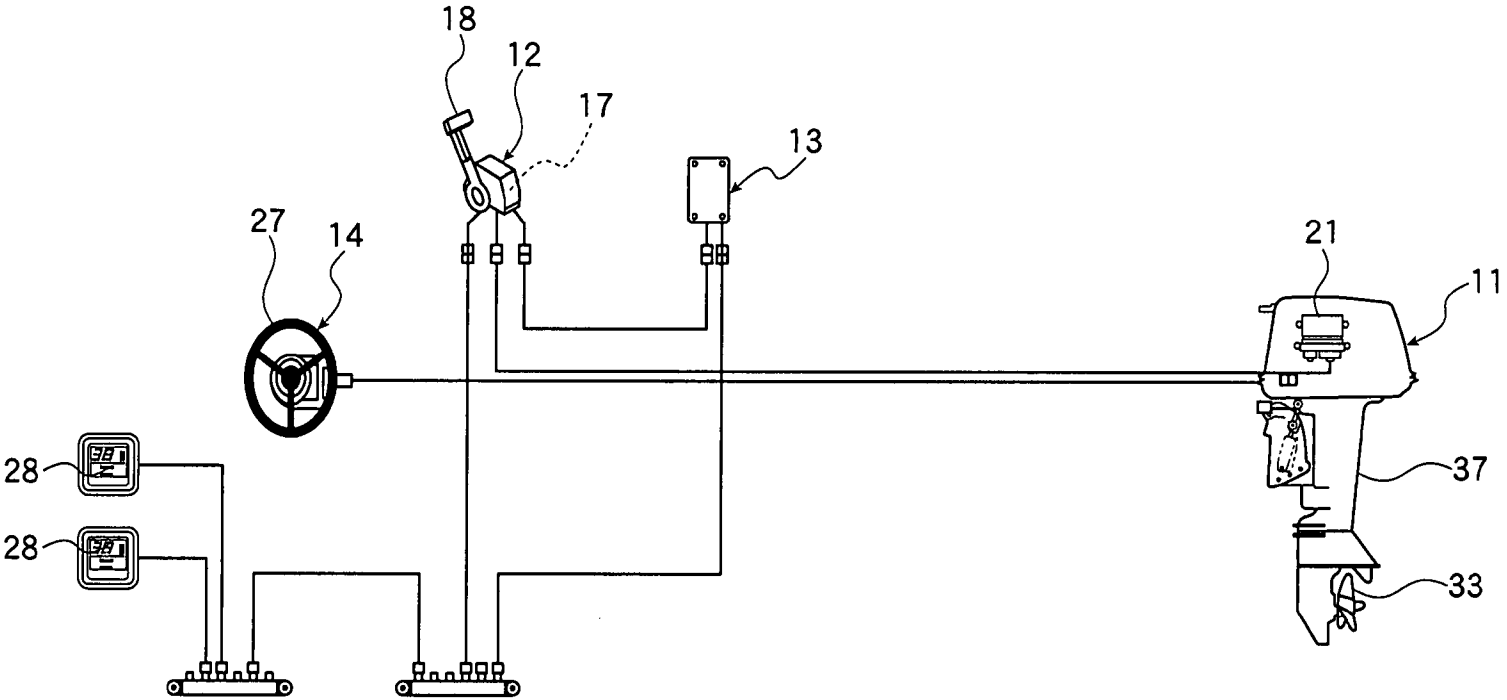
FIG. 2 is a schematic diagram illustrating connections between a remote control operation unit, a key switch unit, an outboard motor and the like that can be used with the boat of FIG. 1.

As shown in FIGS. 1 and 2, the boat can include a hull 10 with an outboard motor 11 which can serve as a "boat propulsion unit" mounted to the stem of the hull 10 However, other types of systems can serve as the propulsion unit.

With reference to FIG. 1, on the operator's side of the hull 10, there can be provided a remote control operation unit 12, a key switch unit 13, a steering wheel unit 14 and the like, through which the outboard motor 11 can be controlled to operate the boat. However, other arrangements and configurations can also be used.

Figure 5:
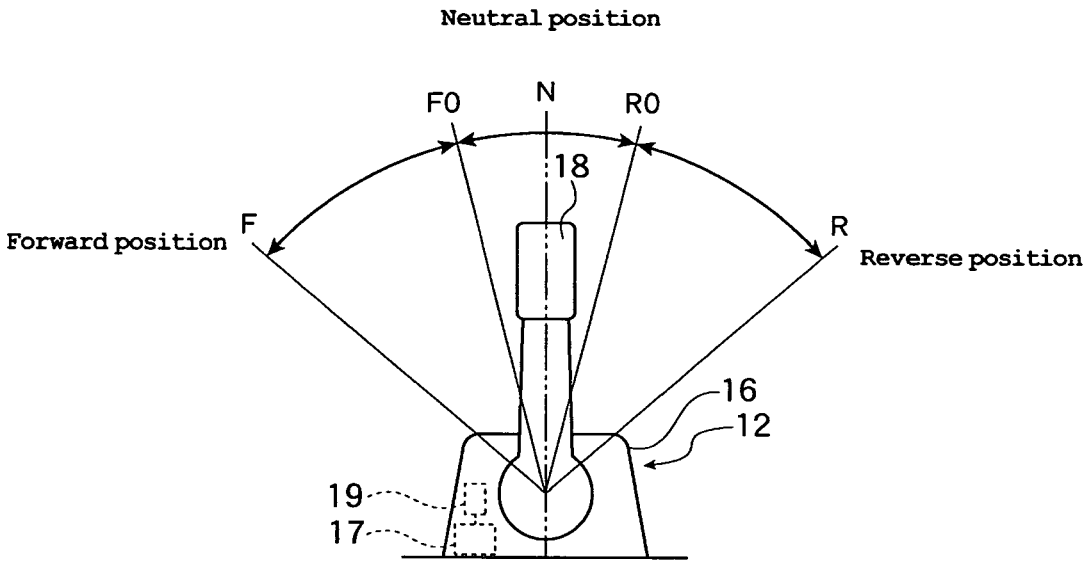
FIG. 5 is a schematic side elevational view of a remote control shift lever that can be used with the boat of FIG. 1.

With reference to FIG. 5, The remote control operation unit 12 can have a remote control ECU 17 included in a remote control body 16, and can also be provided with a remote control shift lever 18 through which a boat operator can perform throttle and shift operations. Operating the remote control shift lever 18 permits remote shifting between forward, neutral, and reverse drive modes.

With continued reference to FIG. 5, a central position where the remote control shift lever 18 is held in a generally vertical direction can be defined as a neutral position (N). In some applications where the body 12 is mounted to an inclined surface, the lever 18 might be at a non-vertical orientation in the neutral position. In such applications, the lever 18 might be generally perpendicular relative to the surface to which the body 12 is mounted. However, other orientations can also be used as the neutral position.

A position where the remote control shift lever 18 is held forward at a predetermined angle relative to the neutral position can be defined as a forward position (F). Additionally, a position where the remote control shift lever 18 is held rearward at a predetermined angle relative to the neutral position can be defined as a reverse position (R). Information on the operation speed of the remote control shift lever 18 and the angle to which the remote control shift lever 18 has been set, can be to be detected by a potentiometer 19 and then transmitted to the remote control ECU 17.

Figure 6:
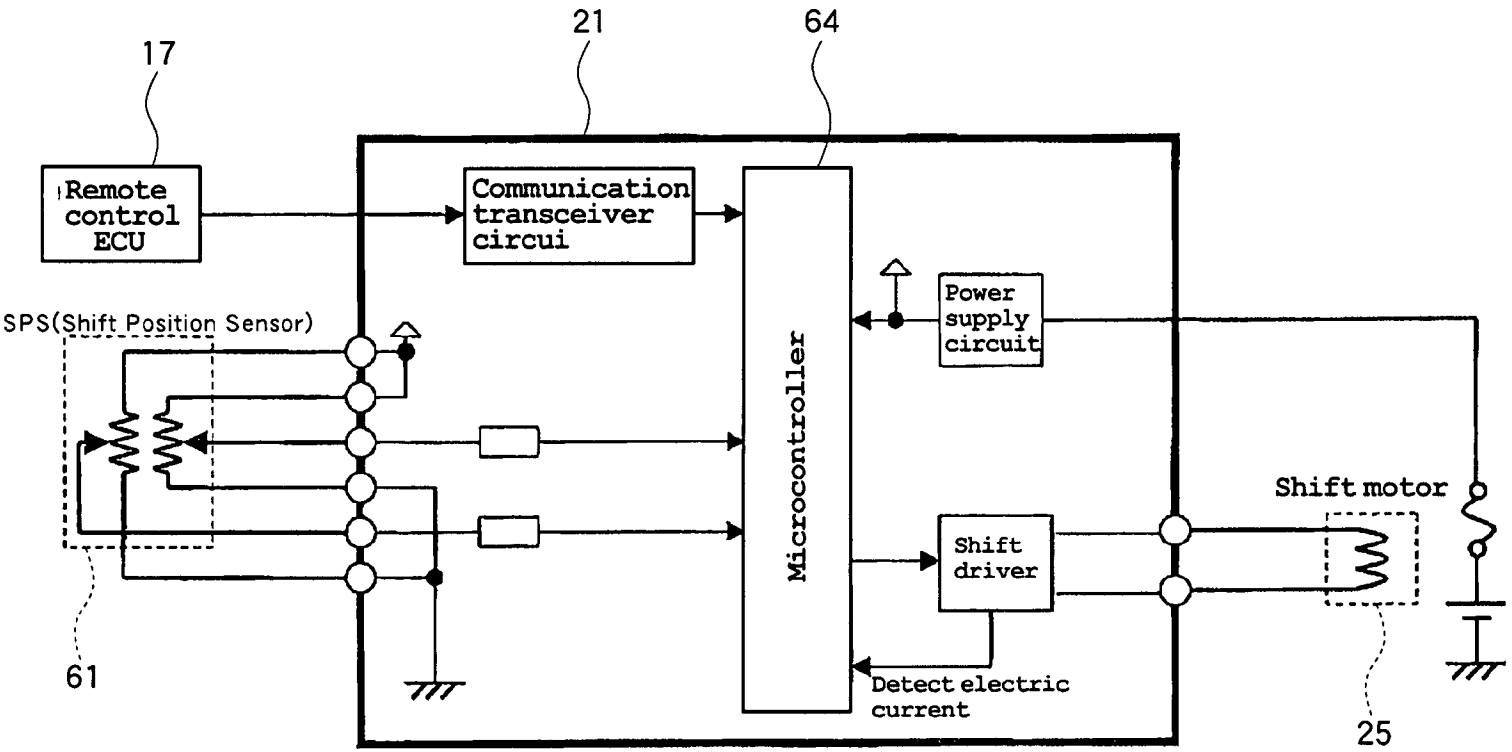
FIG. 6 is a block diagram illustrating a remote control ECU, an engine ECU and other associated components that can be used with the boat of FIG. 1.

As shown in FIG. 6, a signal output from the remote control ECU 17 can be transmitted to an engine ECU 21 of the outboard motor 11. The engine ECU 21 can be configured to control the operation of a shift motor 25 of a shift actuator 22 (FIG. 4) in response to the information on the operation amount of the remote control shift lever 18. The shift actuator 22 can be configured to actuate a shift switching device 23 (FIG. 3) to shift between the forward, neutral, and the reverse drive modes.

As shown in FIG. 2, the remote control ECU 17 of the remote control operation unit 12 can be connected to the key switch unit 13 described above. The key switch unit 13 can include a start switch and a main/stop switch, which are not shown in the figure. Other configurations can also be used.

The steering wheel unit 14 can include a steering wheel ECU (not shown) therein, and can also be provided with a steering wheel 27 through which the boat operator can perform steering operations. The position of the steering wheel can be detected by a position sensor, which can be connected to the steering wheel ECU via a signal circuit.

The steering wheel ECU of the steering wheel unit 14 can be connected to the engine ECU 21 of the remote control operation unit 12 via a DBWCAN cable as a signal line. Here, the term "DBW" is an abbreviation for "Drive-By-Wire", and refers to a manipulation device through electrical connection instead of mechanical connection. Also, the term "CAN" is an abbreviation for "Controller Area Network". However, other types of networks and communication techniques can also be used. Gauges 28 can also be connected to the remote control operation unit 12 and/or other devices.

The outboard motor 11 can also include an engine 30 disposed in an upper portion thereof. The engine 30 can be adapted such that the output of the engine 30 is transmitted to a propeller shaft 34 with a propeller 33 secured thereto, via a drive shaft 31 and a shift device 32. However, other configurations can also be used.

Shifting the shift device 32 between the forward, neutral, and the reverse drive modes can be performed by the shift switching device 23, which is configured to be operated by the shift actuator 22 described above.

Figure 3:
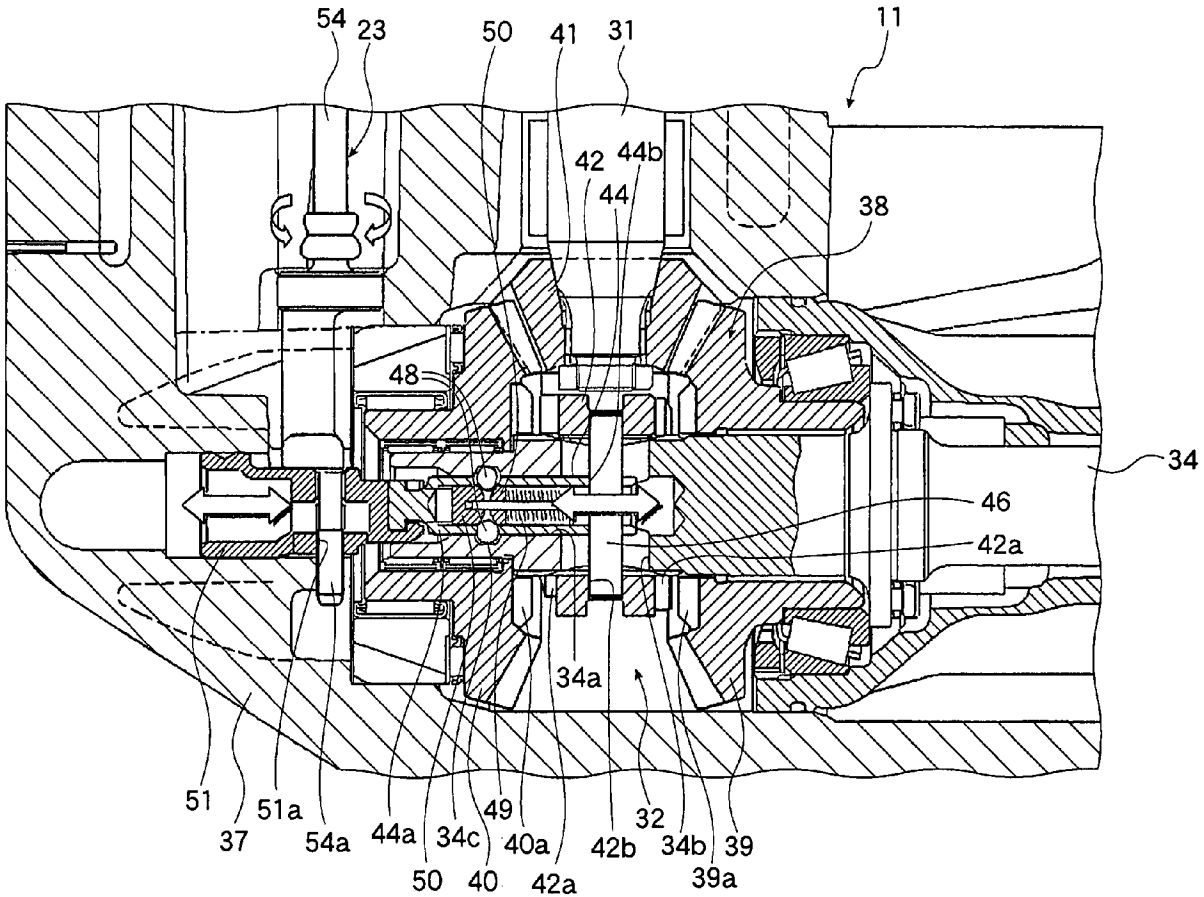
FIG. 3 is a sectional view of a shift device that can be used with the boat of FIG. 1.

For example, as shown in FIGS. 1 to 3, the outboard motor 11 can have a propeller 33 mounted to the propeller shaft 34 that is disposed in a space defined by a casing 37 and extends substantially horizontally. The propeller shaft 34 can be coupled to the drive shaft 31 via a forward/reverse drive switching or "shifting" gear mechanism 38.

The gear mechanism 38 can include a forward gear 39 and a reverse gear 40, both of which can be rotatably mounted on the propeller shaft 34. The drive shaft 31 can be configured to be driven clockwise (as viewed from above), and can have a pinion 41 secured thereto. The gears 39 and 40 are configured for meshing engagement with the pinion 41 and are adapted for rotation in opposite directions relative to each other. However other configurations can also be used.

The forward gear 39 can be disposed rearwardly (the forward direction of the boat being leftward in FIG. 3), and the reverse gear 40 can be disposed forwardly.

A sleeve-like dog clutch 42 can be located between the gears 39 and 40 and can be in spline engagement with the periphery of the propeller shaft 34. The dog clutch 42 can be made slidable in the axial direction of the propeller shaft 34. The dog clutch 42 can have dogs 42*a* projecting from opposite sides thereof in the axial direction. The gears 39 and 40 respectively have dogs 39*a* and 40*a* which can be in opposed relation to the corresponding dogs 42*a* so as to form a "dog clutch".

The propeller shaft 34 can have a forward end having an insertion hole 34*a* that extends in the axial direction and can be open at its front end. A shift sleeve 44 can be received in the insertion hole 34*a* in a manner so as to be slidable in the axial direction. The sidewall of the insertion hole 34*a* of the propeller shaft 34 has an axially extending slot 34*b*. However other configurations can also be used.

The shift sleeve 44 and the dog clutch 42 respectively can have through holes 44*b* and 42*b* extending across the diameters thereof. A pin 46 can be received in the through hole 42*b* of the dog clutch 42, the slot 34*b* of the propeller shaft 34, and the through hole 44*b* of the shift sleeve 44.

In this structure, the movement of the shift sleeve 44 causes the pin 46 to move in the axial direction within the slot 34*b*, causing the dog clutch 42 to move in the axial direction of the propeller shaft 34 via the pin 46.

The shift sleeve 44 can have detent balls 48 disposed thereon in a manner to come into and out of the peripheral face thereof to disengagement from and engagement with recesses 34*c* of the propeller shaft 34. The detent balls 48 are normally urged outwardly by a spring 49 and a pressing member 50.

The forward end 44*a* of the shift sleeve 44 can be coupled to a shifter 51 that can be made slidable in the lateral direction in FIG. 3. The shifter 51 has an engagement groove 51*a* extending in a vertical direction.

A shift shaft 54 of the shift switching device 23 has a lower end with a cranked portion that can be disposed eccentrically from the axis of rotation of the shift shaft 54. The cranked portion has an actuation pin 54*a*, which can be received in the engagement groove 51*a*. As the shift shaft 54 is rotated, the actuation pin 54*a* eccentrically rotates, causing the shifter 51 to slide in a manner to slide the dog clutch 42.

Rotation of the shift shaft 54 in one direction causes the dog clutch 42 to slide in the one direction, while rotation of the shift shaft 54 in the other direction causes the dog clutch 42 to slide in the other direction. However other configurations can also be used.

Figure 4:
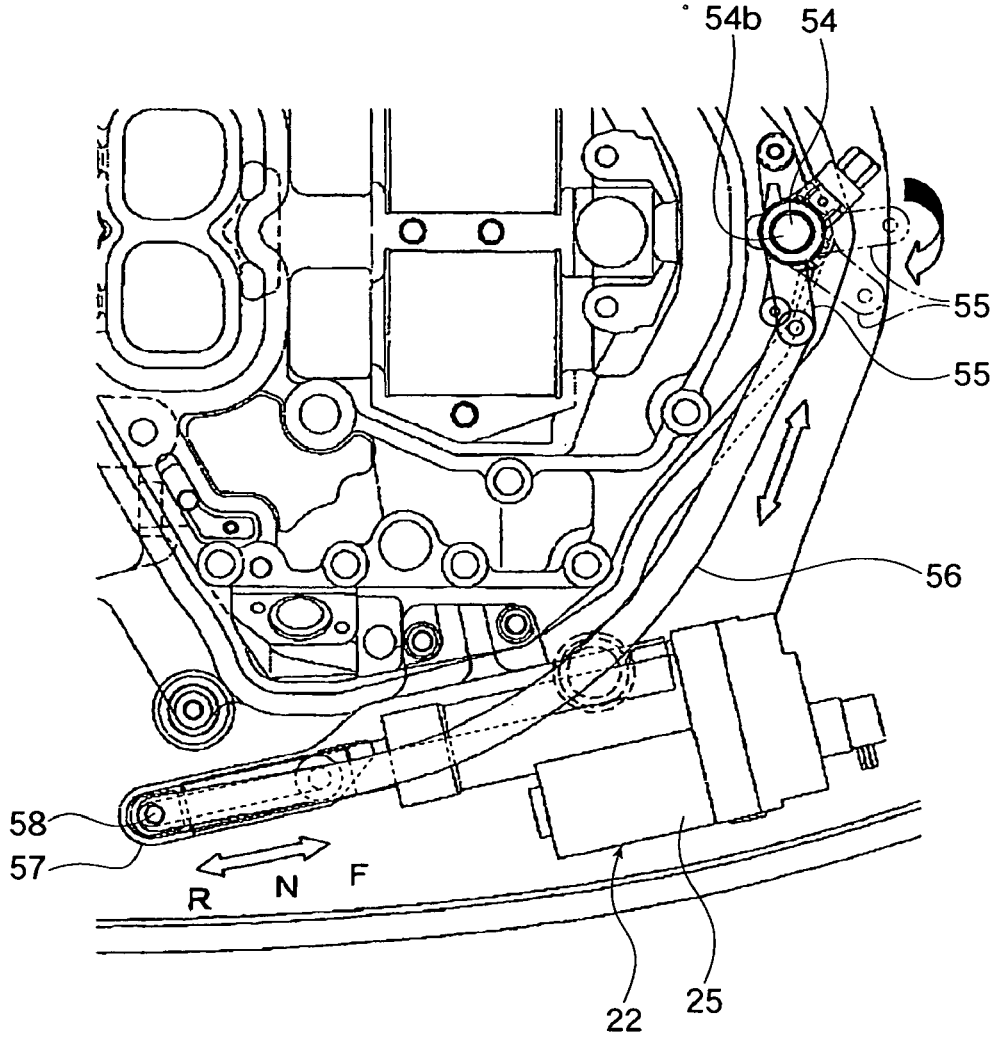
FIG. 4 is an enlarged plan view of a shift actuator and some associated components that can be used with the boat of FIG. 1.

The shift shaft 54 extends in the vertical direction, and as shown in FIG. 4 (plan view), the upper end 54*b* of the shift shaft 54 can be secured to a lever 55. The lever 55 has a distal end coupled to a pivotal end of a lever shift rod 56. The other end of the lever shift rod 56 can be pivotally coupled to a slider 58 that can be configured to be slidable along a shift rail 57. As the shift actuator 22 slides the slider 58, the shift shaft 54 is rotated via the lever shift rod 56 and the lever 55.

The shift actuator 22 can include the shift motor 25 that can be a DC motor, a speed reducer and the like, and serves to operate the slider 58 in predetermined directions. As such, the shift motor 25 serves as a drive source.

As shown in FIG. 6, the shift actuator 22 can be provided with a shift position sensor 61, which can be configured to detect shift positions (forward, neutral, and reverse positions) of the shift actuator. A signal output from the shift position sensor 61 can be input to a microcontroller 64 of the engine ECU 21.

Figure 8:
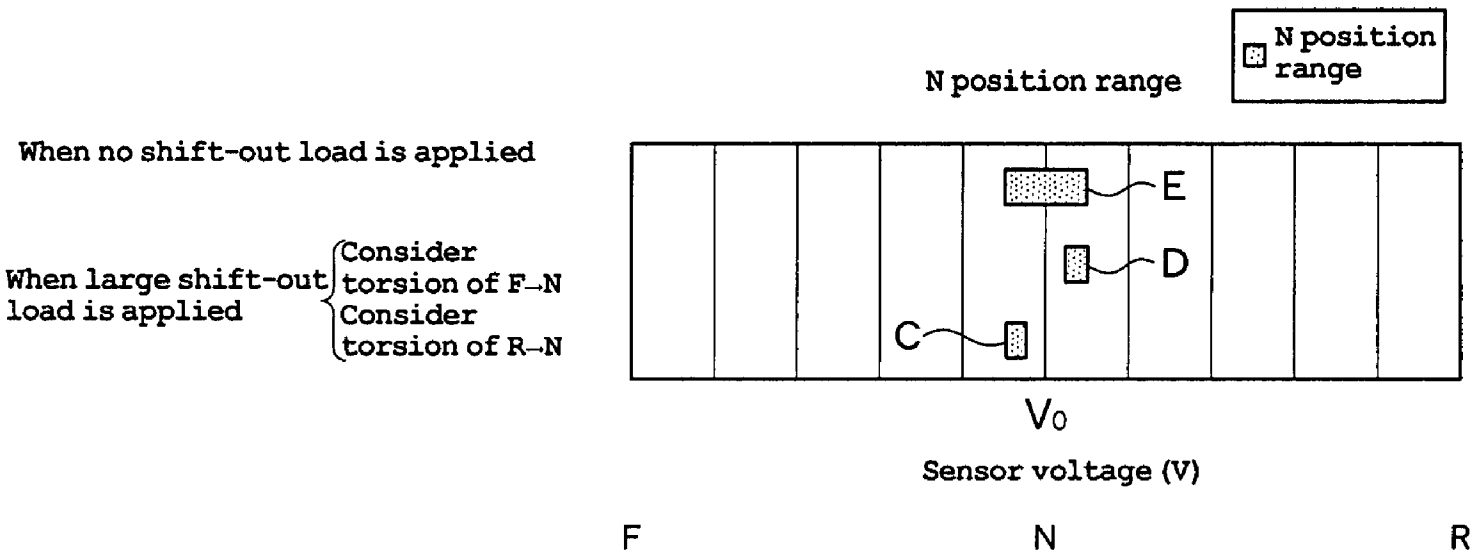
FIG. 8 schematically illustrates a neutral position range that can be sued with the boat of FIG. 1.
Figure 9:
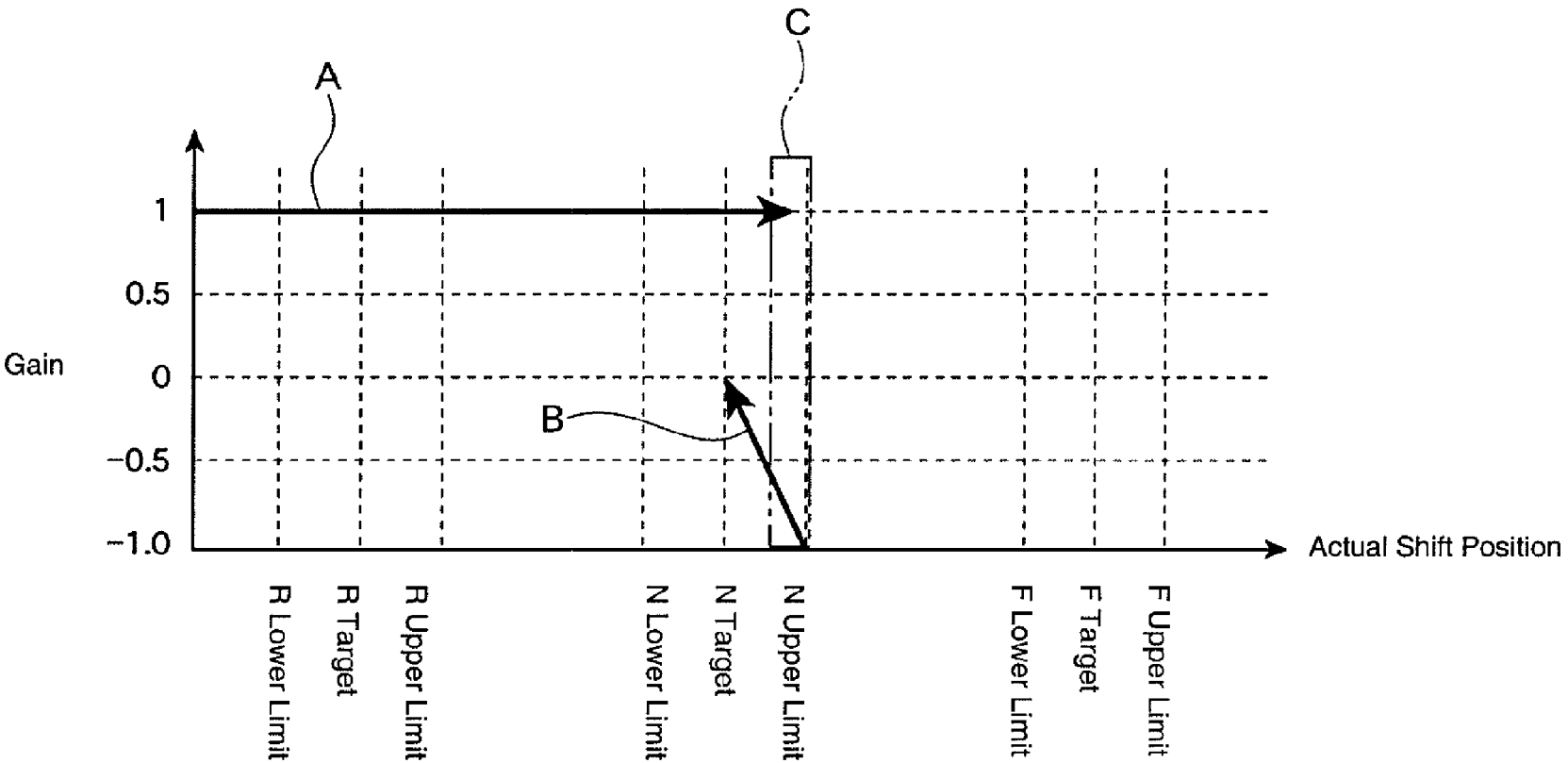
FIG. 9 illustrates exemplary relations between actual shift positions and gains during a shift control process, during shifting from a reverse position to a neutral position.
Figure 10:
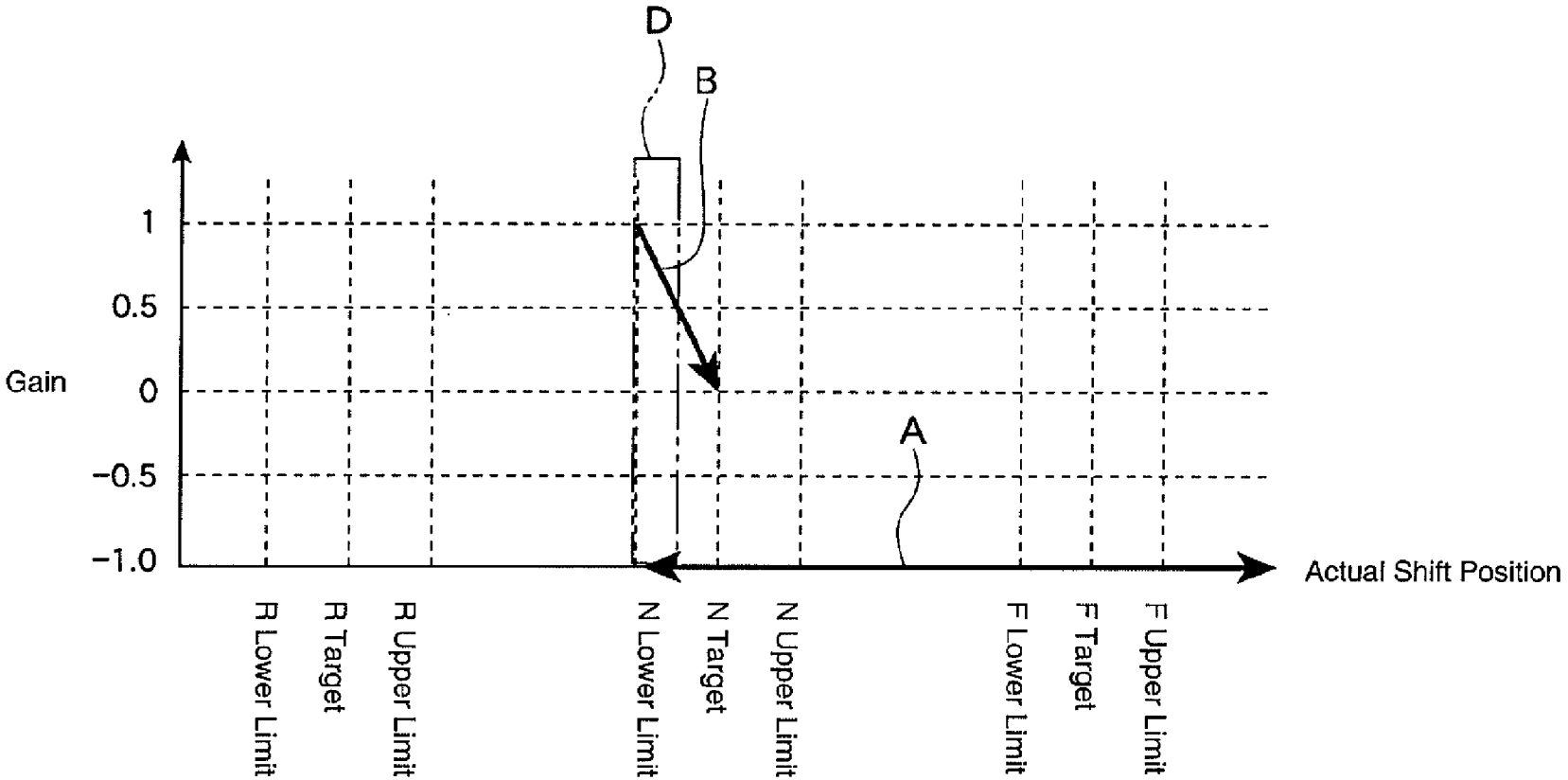
FIG. 10 illustrates exemplary relations between actual shift positions and gains during a shift control process during shifting from a forward position to a neutral position.

The microcontroller 64, which can serve as a "control means", can be configured to control the operation of the shift actuator 22 such that the shift actuator achieves a first target position that can be a position beyond a reference position of the shift actuator 22 where the dog clutch 42 is in the middle of a neutral range, when the remote control shift lever 18 has been shifted from the forward position or the reverse position to the neutral position. That is, the neutral range of the dog clutch 42 is in corresponding relation to the neutral position range of the shift actuator 22 (range from N end to N beginning in FIGS. 9 and 10). It should be noted that the reference position of the shift actuator 22 where the dog clutch 42 is in the middle of the neutral range refers to $V_0$ in FIG. 8 and N target in FIGS. 9 and 10.

The microcontroller 64 can be adapted to execute a first control A in which the shift actuator is controlled to achieve a first target position beyond the reference position and a gain can be kept substantially constant, and a second control B in which the shift actuator can be controlled to achieve the reference position within a neutral position range from a neutral position ensuring range (ranges indicated by rectangles in FIG. 8 and ranges indicated by chain double-dashed lines in FIGS. 9 and 10) C, D and the gain can be changed to 0.

The neutral position ensuring range C of the shift actuator can be a predetermined range for ensuring shifting out of the reverse position into the neutral position when a shift-out load is large, and the neutral position ensuring range D of the shift actuator can be a predetermined range for ensuring shifting out of the forward position into the neutral position when the shift-out load is large. The neutral position ensuring ranges C, D are determined by experiments, calculations or the like. It should be noted that symbol E in FIG. 8 denotes the neutral position range of the shift actuator where no shift-out load is applied.

Figure 7:
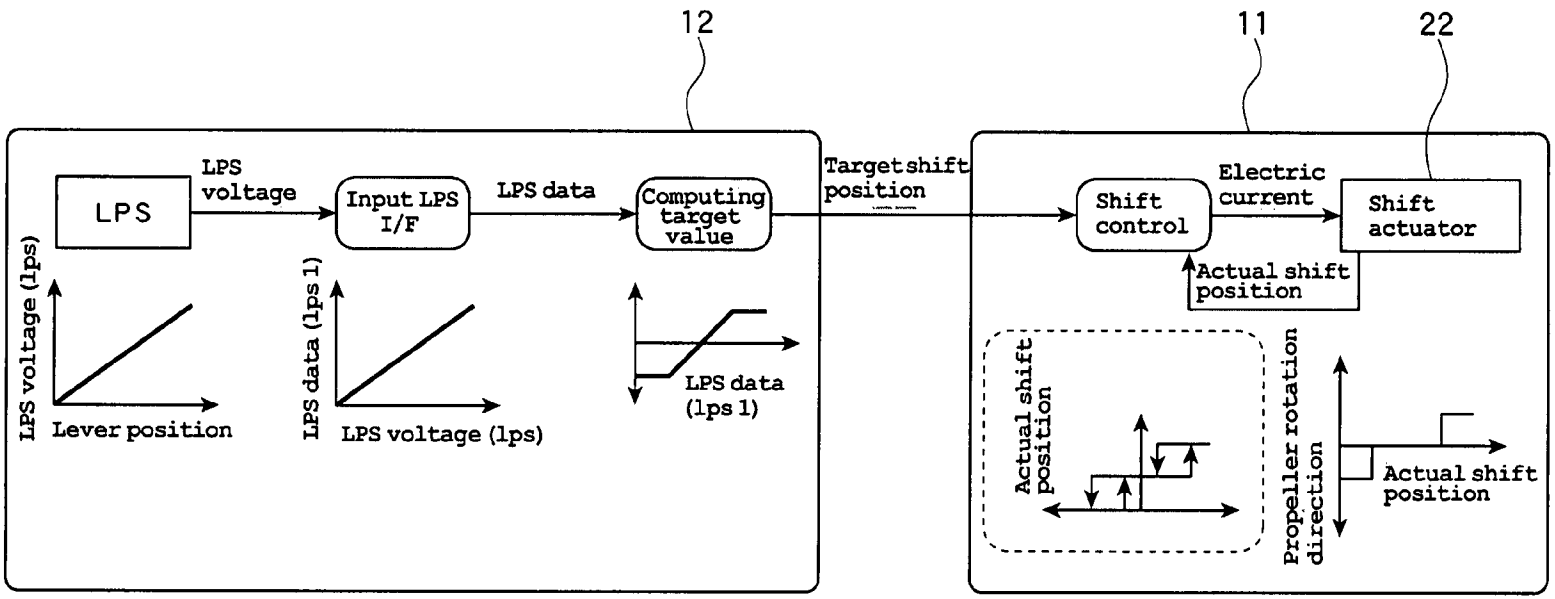
FIG. 7 illustrates a control flow for the boat in accordance with an embodiment.

During operation, as the remote control shift lever 18 of the remote control operation unit 12 pivots from the forward position or the reverse position to the neutral position, the position of the remote control shift lever 18 can be detected by the potentiometer 19. The detected position can then be input to the remote control ECU 17 and converted to a lever position voltage (LPS voltage) as shown in FIG. 7.

The lever position voltage can be input to an interface (I/F) and then converted to lever position data (LPS data). The lever position data can be used to compute the reference position of the shift actuator, converted to a target shift position signal, and then input to the microcontroller 64 of the engine ECU 21 for shift control. In response to the shift control by the microcontroller, a predetermined amount of electric current can be applied to the shift actuator 22 so that the shift motor 25 of the shift actuator 22 can be operated at a desired direction at a desired speed.

An actual shift position of the shift actuator 22 can be detected by the shift position sensor 61 and then fed back to the microcontroller 64 to effect a shift control to achieve a desired position of the shift actuator. For example, the microcontroller 64 can be configured to use the actual shift position for controlling the shift actuator 22 in a feedback control manner.

As the shift motor 25 of the shift actuator 22 is operated, the dog clutch 42 is made to slid in a certain direction via the slider 58, the lever shift rod 56, the shift shaft 54, the shifter 51, the shift sleeve 44, the pin 46 and the like, thereby achieving shifting to a desired position.

Shifting out of the reverse position (R) into the neutral position (N) is described below. As the remote control shift lever 18 pivots from the reverse position (R) to the neutral position (N), the shift actuator 22 can be controlled as described above to cause the slider 58 to slide from a reverse position (R) to a neutral position (N). Then, the dog clutch 42 can be made to slide from a reverse position (R), where the dog clutch is in engagement with the reverse gear 40, to a neutral position (N) via the shift shaft 54 and the like as described above to achieve shift-out.

When the dog clutch 42 is in engagement with the reverse gear 40 and when engine speed is high, the engagement part can be subjected to a large engagement force. Thus, a large shift-out load is applied when the dog clutch shifts out of the reverse position into the neutral position. In this case, the present embodiments can provide the advantage of reliable shift-out.

For example, when a target shift position (neutral position) signal has been input from the remote control ECU 17 to the microcontroller 64 of the engine ECU 21, it is determined whether the remote control shift lever was in the reverse position (R) or the forward position (F) most recently. When the determination is that shifting is being made out of the reverse position (R) into the neutral position (N), the microcontroller controls the shift actuator 22 within the neutral position range (range from N end to N beginning in FIG. 9) so as to achieve a first target position beyond the reference position within the neutral position range (N target in FIG. 9) with the maximum gain (+1), as indicated by the first control A in FIG. 9.

The first target position can be within the predetermined neutral position ensuring range (range indicated by chain double-dashed lines in FIG. 9) C for ensuring shifting out of the reverse position into the neutral position.

Thereafter, the microcontroller 64 can execute the second control B, in which the shift actuator can be controlled to achieve the reference position within the neutral position range (N target in FIG. 9) from the neutral position ensuring range C and the gain can be changed to 0.

On the other hand, shifting out of the forward position (F) into the neutral position (N) can be performed in an opposite manner to the case described above. That is, as the remote control shift lever 18 pivots from the forward position (F) to the neutral position (N), the shift actuator 22 can be controlled as described above to cause the slider 58 to slide from a forward position (F) to the neutral position (N). Then, the dog clutch 42 can be made to slide from a forward position (F), where the dog clutch can be in engagement with the forward gear 39, to the neutral position (N) via the shift shaft 54 and the like as described above to achieve shift-out.

When the dog clutch 42 is in engagement with the forward gear 39 and when engine speed is high, the engagement part can be subjected to a large engagement force. Thus, a large shift-out load will be applied when the dog clutch shifts out of the forward position into the neutral position. In this case, the present embodiments can provide the advantage of reliable shift-out.

For example, when a target shift position (neutral position) signal has been input from the remote control ECU 17 to the microcontroller 64 of the engine ECU 21, it can be determined whether the remote control shift lever was in the reverse position (R) or the forward position (F) most recently. When the determination is made such that shifting is being made out of the forward position (F) into the neutral position (N), the microcontroller 64 can control the shift actuator 22 within the neutral position range (range from N end to N beginning in FIG. 10) so as to achieve a first target position beyond the reference position within the neutral position range (N target in FIG. 10) with the maximum gain (−1), as indicated by the first control A in FIG. 10.

The first target position can be within the predetermined neutral position ensuring range (range indicated by chain double-dashed lines in FIG. 10) D for ensuring shifting out of the forward position into the neutral position.

Thereafter, the microcontroller 64 can execute the second control B, in which the shift actuator can be controlled to achieve the reference position within the neutral position range from the neutral position ensuring range D and the gain can be changed to 0.

In such a structure, when the remote control shift lever 18 has been shifted from the forward position or the reverse position to the neutral position, the shift actuator 22 can be controlled to achieve the first target position that can be a position beyond the reference position of the shift actuator 22 where the dog clutch 42 is in the middle of the neutral range. It is thus possible to provide reliable control of shifting from the forward position or the reverse position to the neutral position even when a shift-out load is large.

Further, the first target position can be within the predetermined neutral position ensuring range C, D for ensuring shifting out of the forward position or the reverse position into the neutral position, thereby effecting reliable shifting to the neutral position.

Further, switching from the first control A to the second control B can be subject to the shift position within the neutral position ensuring range C, D. This makes it possible to provide reliable shift-out through the control of shifting from the forward position or the reverse position to the neutral position even when a shift-out load is large, and avoid shifting beyond the neutral position into the forward position or the reverse position.

In some embodiments, the microcontroller 64 can be configured to determine shift-out characteristics in response to shift speed at which shifting can be made from the forward position or the reverse position to the neutral position or to the amount of electric current applied to the shift actuator 22, to vary the gain. The microcontroller 64 can thereby execute improved control in response to a change in boat operating conditions such as a shift-out load.

For example, for high shift speed scenarios, it can be determined that the shift-out characteristics are high, so that the gain can be set to be small. On the other hand, when a large amount of electric current is applied to the shift actuator, the dog clutch can be subjected to a large force, so that it is determined that the shift-out characteristics are low, and the gain can be increased correspondingly. It is thus possible to effect enhanced control in response to a change in boat operating conditions such as a shift-out load with minimal power consumption.

Further, the microcontroller 64 can be configured to determine shift-out characteristics in response to shift speed at which shifting can be made from the forward position or the reverse position to the neutral position or to the amount of electric current applied to the shift actuator, to vary the point of switching from the first control A to the second control B.

For example, for high shift speed scenarios, it can be determined that the shift-out characteristics are high, so that the switching point can be set toward the reference position within the neutral position range. On the other hand, when a large amount of electric current is applied to the shift actuator, the dog clutch can be subjected to a large force, so that it can be determined that the shift-out characteristics are low, and the switching point can be set in the direction away from the reference position within the neutral position range correspondingly. It is thus possible to effect enhanced control in response to a change in boat operating conditions such as a shift-out load with minimal power consumption.

Further, the microcontroller 64 can be adapted to store information on previous control during shifting of the remote control shift lever 18 from the forward position or the reverse position to the neutral position, to vary the gain based on the stored information. As such, the microcontroller 64 can "learn" how to further enhance shifting operations based on past performance. This provides better responsiveness to the engine 30 and the boat, effecting more reliable control to the neutral position.

For example, when the first control A is executed using a predetermined gain for example, shift-out characteristics can be higher or lower than expected. The microcontroller 64 thus can be configured to store such information and use them to obtain an enhanced gain, so that responsiveness to the engine 30 and the boat is enhanced, effecting more reliable control to the neutral position.

The microcontroller 64 can also be adapted to store information on previous control during shifting of the remote control shift lever 18 from the forward position or the reverse position to the neutral position, to vary the point of switching from the first control A to the second control B based on the stored information. This provides better responsiveness to the engine 30 and the boat, effecting more reliable control to the neutral position.

For example, when control is executed with a predetermined point of switching from the first control A to the second control B for example, shift-out characteristics can be higher or lower than expected. The microcontroller 64 thus can be configured to store such information and to use them to determine an enhanced switching point, so that responsiveness to the engine 30 and the boat is enhanced, effecting more reliable control to the neutral position.

Further, the second control B executed by the microcontroller 64 can have characteristics of a linear or non-linear form at any angle, making it possible for the shift actuator to achieve the reference position promptly after shift-out.

It should be understood that while in the foregoing embodiment, the outboard motor 11 can be employed as the "boat propulsion unit," it may be replaced by an inboard-outdrive engine or the like.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat comprising:

a remote control operation unit having a remote control shift lever configured to allow a boat operator to remotely select a forward, neutral, and reverse drive mode;

a boat propulsion unit having a shift switching device configured to selectively shift between the forward, neutral, and reverse drive modes, and a shift actuator configured to operate the shift switching device; and a control means for controlling the operation of the shift actuator in response to the operation amount of the remote control shift lever, when the remote control shift lever has been operated within a certain range of a shift range, wherein the control means controls the shift actuator such that the shift actuator achieves a first target position that is a position beyond a reference position of the shift actuator where a dog clutch is in the middle of a neutral range, when the remote control shift lever has been shifted from either a forward position or a reverse position to a neutral position.

2. The boat according to claim 1, wherein the first target position is within a predetermined neutral position ensuring range for ensuring shifting out of the forward position or the reverse position into the neutral position.

3. The boat according to claim 2, wherein the control means executes a first control in which the shift actuator is controlled to achieve the first target position beyond the reference position and a gain is kept substantially constant, and a second control in which the shift actuator is controlled to achieve the reference position from the neutral position ensuring range and the gain is changed to 0, when the remote control shift lever has been shifted from either the forward position or the reverse position to the neutral position.

4. The boat according to claim 1, wherein the control means determines shift-out characteristics in response to shift speed at which shifting is made from the forward position or the reverse position to the neutral position or to the amount of electric current applied to the shift actuator, to vary the gain.

5. The boat according to claim 3, wherein the control means determines shift-out characteristics in response to shift speed at which shifting is made from the forward position or the reverse position to the neutral position or to the amount of electric current applied to the shift actuator, to vary the gain.

6. The boat according to claim 3, wherein the control means determines shift-out characteristics in response to shift speed at which shifting is made from the forward position or the reverse position to the neutral position or to the amount of electric current applied to the shift actuator, to vary a point of switching from the first control to the second control.

7. The boat according to claim 1, wherein the control means stores information on previous control during shifting of the remote control shift lever from either the forward position or the reverse position to the neutral position, to vary the gain based on the stored information.

8. The boat according to claim 1, wherein the control means includes means for learning to enhance shifting operations based on previous control during shifting of the remote control shift lever from either the forward position or the reverse position to the neutral position.

9. The boat according to claim 3, wherein the control means stores information on previous control during shifting of the remote control shift lever from either the forward position or the reverse position to the neutral position, to vary a point of switching from the first control to the second control based on the stored information.

10. The boat according to claim 3, wherein the second control has characteristics of a linear or non-linear form at any angle.

11. A boat comprising:

a remote control operation unit having a remote control shift lever configured to allow a boat operator to remotely select a forward, neutral, and reverse drive mode;

a boat propulsion unit having a shift switching device configured to selectively shift between the forward, neutral, and reverse drive modes, and a shift actuator configured to operate the shift switching device; and a controller configured to control the operation of the shift actuator in response to the operation amount of the remote control shift lever, when the remote control shift lever has been operated within a certain range of a shift range, wherein the controller is configured to control the shift actuator such that the shift actuator achieves a first target position that is a position beyond a reference position of the shift actuator where a dog clutch is in the middle of a neutral range, when the remote control shift lever has been shifted from either a forward position or a reverse position to a neutral position.

12. The boat according to claim 11, wherein the first target position is within a predetermined neutral position ensuring range for ensuring shifting out of the forward position or the reverse position into the neutral position.

13. The boat according to claim 12, wherein the controller is configured to execute a first control in which the shift actuator is controlled to achieve the first target position beyond the reference position and a gain is kept substantially constant, and a second control in which the shift actuator is controlled to achieve the reference position from the neutral position ensuring range and the gain is changed to 0, when the remote control shift lever has been shifted from either the forward position or the reverse position to the neutral position.

14. The boat according to claim 11, wherein the controller is configured to determine shift-out characteristics in response to shift speed at which shifting is made from the forward position or the reverse position to the neutral position or to the amount of electric current applied to the shift actuator, to vary the gain.

15. The boat according to claim 13, wherein the controller is configured to determine shift-out characteristics in response to shift speed at which shifting is made from the forward position or the reverse position to the neutral position or to the amount of electric current applied to the shift actuator, to vary the gain.

16. The boat according to claim 13, wherein the controller is configured to determine shift-out characteristics in response to shift speed at which shifting is made from the forward position or the reverse position to the neutral position or to the amount of electric current applied to the shift actuator, to vary a point of switching from the first control to the second control.

17. The boat according to claim 11, wherein the controller is configured to store information on previous control during shifting of the remote control shift lever from either the forward position or the reverse position to the neutral position, to vary the gain based on the stored information.

* * * * *